US006176742B1

(12) United States Patent
Arnett et al.

(10) Patent No.: US 6,176,742 B1
(45) Date of Patent: Jan. 23, 2001

(54) CAPACITIVE CROSSTALK COMPENSATION ARRANGEMENT FOR COMMUNICATION CONNECTORS

(75) Inventors: Jaime Ray Arnett, Fishers; Robert Ray Goodrich, Indianapolis, both of IN (US); Amid Ihsan Hashim, Randolph, NJ (US)

(73) Assignee: Avaya Inc., Basking Ridge, NJ (US)

( * ) Notice: Under 35 U.S.C. 154(b), the term of this patent shall be extended for 0 days.

(21) Appl. No.: 09/344,831

(22) Filed: Jun. 25, 1999

(51) Int. Cl.[7] ..... H01R 13/66; H01R 33/945
(52) U.S. Cl. ..... 439/620; 439/676; 439/941
(58) Field of Search ..... 439/676, 620, 439/941

(56) References Cited

U.S. PATENT DOCUMENTS 5,299,956 4/1994 Brownell et al. .
5,547,405 8/1996 Pinney et al. .
5,586,914 * 12/1996 Foster, Jr. et al. ..... 439/676
5,599,209 * 2/1997 Belopolsky ..... 439/676
5,626,497 * 5/1997 Bouchan et al. ..... 439/676
5,716,237 * 2/1998 Conorich et al. ..... 439/941
5,947,772 * 9/1999 Arnett et al. ..... 439/676
6,042,427 * 3/2000 Adriaenssens et al. ..... 439/676

* cited by examiner

*Primary Examiner*—Khiem Nguyen
*Assistant Examiner*—Hae Moon Hyeon
(74) *Attorney, Agent, or Firm*—Law Office of Leo Zucker

(57) ABSTRACT

Capacitive crosstalk compensation coupling is achieved in a communication connector by the use of a capacitor compensation assembly. The assembly includes a housing constructed to be associated with a communication connector having elongated terminal contact wires. One or more crosstalk compensation capacitors are supported in the housing. Each compensation capacitor includes a first electrode having a first terminal, a second electrode having a second terminal, and a dielectric spacer is disposed between the first and the second electrodes. The terminals of the electrodes are exposed at positions outside of the housing so that selected terminal contact wires of the connector make electrical contact with corresponding terminals of the compensation capacitors to provide capacitive coupling between the selected contact wires when the contact wires are engaged by a mating connector.

10 Claims, 6 Drawing Sheets

CAPACITIVE CROSSTALK COMPENSATION ARRANGEMENT FOR COMMUNICATION CONNECTORS

BACKGROUND OF THE INVENTION

1. Field of the Invention

This invention relates to arrangements for providing capacitive crosstalk compensation coupling among signal paths in high frequency communication connectors.

2. Discussion of the Known Art

There is a need for a durable, high frequency communication connector that compensates for (i.e., cancels or reduces) crosstalk among and between different signal paths through the connector. As broadly defined herein, crosstalk occurs when signals conducted over a first signal path, e.g., a pair of terminal contact wires associated with a communication connector, are partly transferred by inductive and/or capacitive coupling into a second signal path, e.g., another pair of terminal contact wires in the same connector. The transferred signals define "crosstalk" in the second signal path, and such crosstalk degrades any signals that are being routed through the second path.

For example, an industry type RJ-45 communication connector has four pairs of terminal wires defining four different signal paths within the connector. In typical RJ-45 plug and jack connectors, all four pairs of terminal wires extend closely parallel to one another over the lengths of the associated connector bodies. Thus, signal crosstalk may be induced between and among different pairs of terminal wires within the typical RJ-45 plug and jack connectors, particularly when the connectors are mated to one another. The amplitude of the crosstalk becomes stronger as the coupled signal frequencies or data rates increase.

Applicable industry standards for rating the degree to which communication connectors exhibit crosstalk, do so in terms of so-called near end crosstalk or "NEXT". Moreover, NEXT ratings are typically specified for mated connector configurations, for example, a type RJ-45 plug and jack combination, wherein input terminals of the plug connector are used as a reference plane.

Communication links using unshielded twisted pairs (UTP) of copper wire are now expected to support data rates up to not only 100 MHz, or industry standard "Category 5" performance; but to meet "Category 6" performance levels which call for at least 46 dB near end crosstalk loss at 250 MHz.

Crosstalk compensating circuitry may also be provided on or within layers of a printed wire board, to which spring terminal contact wires of a communication jack are connected within the jack, housing. See U.S. patent application Ser. No. 08/923,741 filed Sep. 29, 1997, and assigned to the assignee of the present application and invention. All relative portions of the '741 application are incorporated by reference herein. See also U.S. Pat. No. 5,299,956 (Apr. 5, 1994).

U.S. Pat. No. 5,547,405 (Aug. 20, 1996) discloses an electrical connector having signal carrying contacts that are formed on different lead frames. Contacts from one lead frame have integral lateral extensions that overlie enlarged adjacent portions of contacts from another lead frame, to provide capacitive coupling. A dielectric spacer is assembled between an extension of one contact, and an enlarged adjacent portion of another contact. Thus, the signal carrying contacts in the connector of the '405 patent require tooling for two different lead frames, and the contacts must be properly aligned with the dielectric spacer between them during assembly of the connector.

There remains a need for a communications jack connector which, when mated with a typical RJ-45 plug connector, provides such crosstalk compensation that the mated connectors meet or surpass Category 6 performance. It would be especially desirable if such a connector could be manufactured using existing components as much as possible, and without expensive tooling or assembly requirements.

SUMMARY OF THE INVENTION

According to the invention, a capacitor compensation assembly for crosstalk compensation in a communication connector, includes a housing and a crosstalk compensation capacitor supported in the housing. The capacitor has a first metallic electrode with a first terminal, a second metallic electrode with a second terminal, and a dielectric spacer disposed between the electrodes. The housing is dimensioned and arranged to be associated with a communication connector having elongated terminal contact wires. The terminals of the electrodes are exposed at positions outside the housing such that selected terminal contact wires of the connector make electrical contact with corresponding terminals of the electrodes to provide capacitive coupling between the selected terminal contact wires when the contact wires are engaged by a mating connector.

According to another aspect of the invention, a communications jack connector includes a jack frame having a front surface, and a plug opening in the front surface for receiving a mating plug connector. A number of elongated terminal contact wires extend through the jack frame, and the contact wires are configured to make electrical contact with corresponding terminals of the mating connector. One or more crosstalk compensation capacitors are mounted in operative relation to the terminal contact wires. Each capacitor includes a first electrode with a first terminal, a second electrode with a second terminal, and a dielectric spacer disposed between the first and the second electrodes. The terminals of the electrodes are located and configured so that free end portions of selected terminal contact wires make electrical contact with corresponding terminals of the electrodes to provide capacitive coupling between the selected terminal contact wires when the contact wires are engaged by the mating connector.

For a better understanding of the invention, reference is made to the following description taken in conjunction with the accompanying drawing and the appended claims.

DETAILED DESCRIPTION OF THE INVENTION

Figure 1:
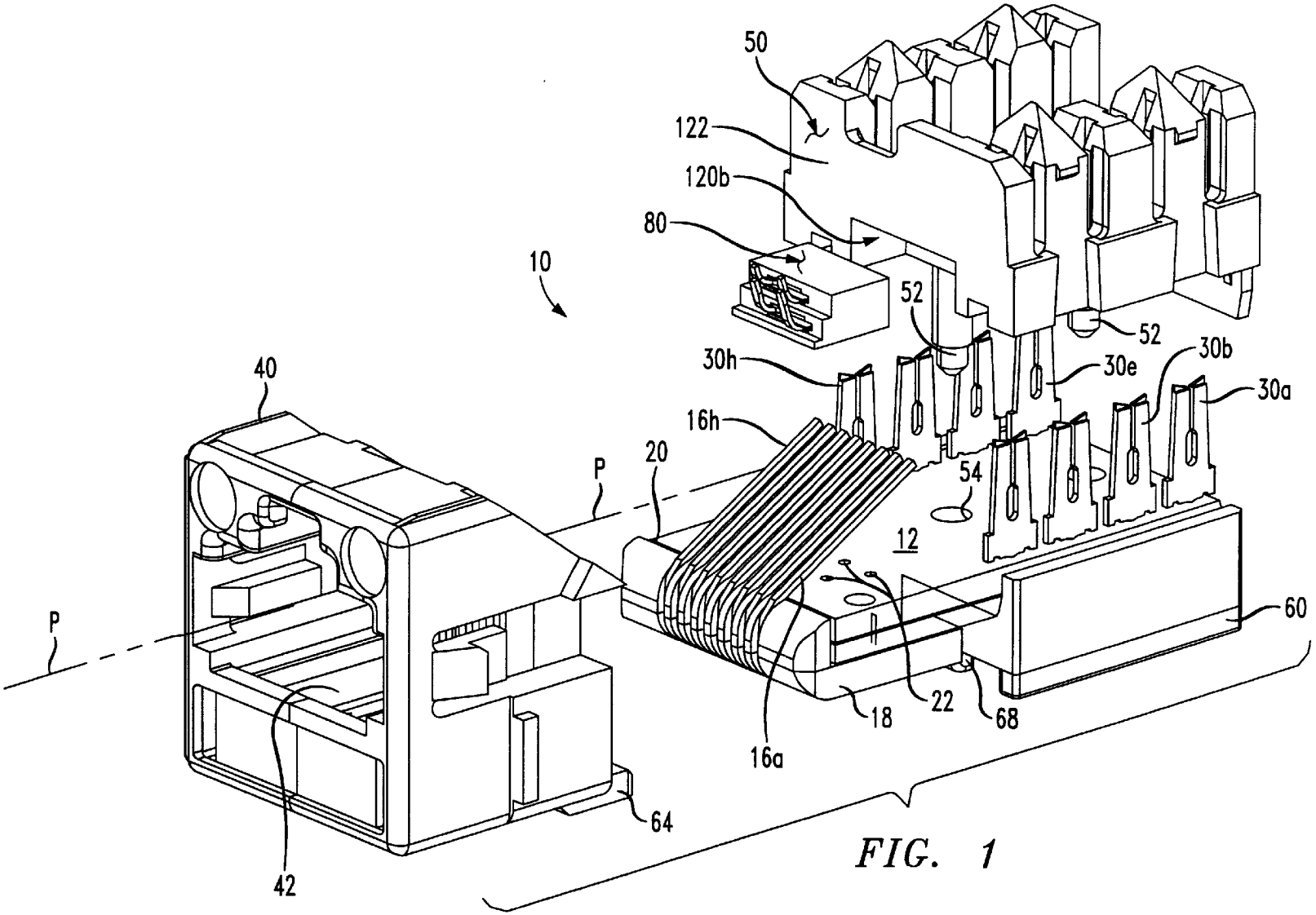
FIG. 1 is an exploded view of a high frequency communication jack connector.

FIG. 1 is an exploded view of a high frequency communication jack connector 10. The jack connector 10 includes a jack frame 40, and a printed wire board 12 having one or more dielectric layers. The board layers may have conductive traces or paths printed on them in certain configurations to provide one or more stages of crosstalk compensation, as disclosed in the earlier-mentioned '741 application. Alternatively or in addition to conductive traces, the wire board 12 may have associated discrete components such as resistors, capacitors and inductors to compensate for or to reduce crosstalk that would otherwise develop among signal paths through the connector 10.

A number, for example, eight elongated spring terminal contact wires 16*a* to 16*h* extend parallel to one another from beneath the board 12, and are directed with a certain bend radius around a jackwire block 18 near a front edge 20 of the board. Parallel free end portions of the contact wires 16*a*–16*h* form an acute angle relative to the top surface of the wire board 12, so as to confront and to make electrical contact with corresponding terminals of a mating plug connector when the latter is received in a plug opening 42 in the jack frame 40 (see FIG. 4). A typical center-to-center spacing between adjacent terminal contact wires is about 0.040 inches.

Base portions of the terminal contact wires 16*a*–16*h* beneath the wire board 12, are inserted into plated terminal openings 22 in the board. The terminal openings 22 extend through the board layers to connect with the conductive traces or other devices on or within the board. The contact wires 16*a*–16*h* are seated in corresponding parallel grooves formed in the leading portion of the jackwire block 18, wherein the bases of the grooves define the bend radius for the contact wires. See co-pending U.S. application Ser. No. 08/904,391 filed Aug. 1, 1997, (now U.S. Pat. No. 5,924,896 issue Jul. 20, 1999), and assigned to the assignee of the present application and invention. All relevant portions of the '391 application are incorporated herein by reference.

Insulation displacement connector (IDC) terminals 30*a* to 30*h* are mounted at either side of a rear portion of the wire board 12, as shown in FIG. 1. The IDC terminals 30*a*–30*h* have mounting parts or "tails" that are press fit or otherwise retained in corresponding terminal openings in the board 12. The IDC terminals 30*a*–30*h* are thus electrically connected to the conductive traces on the board layers, and the terminals 30*a*–30*h* are associated with corresponding ones of the terminal contact wires 16*a*–16*h*. The IDC terminals 30*a*–30*h* are further described in the above-mentioned '391 application.

The jack frame 40 may be similar to the jack frame disclosed in the '391 application. The plug opening 42 in the frame 40 receives a mating plug connector along the direction of a plug axis P through the opening 42. The frame 40 also has a rear opening (see FIG. 4) that is dimensioned to receive a front portion of the wire board 12, including the jackwire block 18 and the parallel free end portions of the terminal contact wires 16*a*–16*h*. When the front portion of the wire board 12 is inserted and mounted within the jack frame 40, the free end portions of the terminal contact wires pass through corresponding vertical slots in a "comb"-like rear wall of the jack frame. The rear vertical slots in the jack frame 40 serve to guide the free end portions of the contact wires when they are deflected toward the board 12 by the action of a plug connector. A desired pre-load bias force is also applied to the free end portions of the contact wires at upper ends of the vertical slots. See FIG. 4.

An electrically insulative or dielectric terminal housing 50 protects the rear top surface portion of the wire board 12, and permits wire lead access to and connection with the IDC terminals 30*a*–30*h* on top of the wire board. The terminal housing 50 may be formed of a plastics material that meets all applicable standards with respect to electrical insulation and flammability. Such materials include, but are not limited to, polycarbonate, ABS, and blends thereof.

The terminal housing 50 has a pair of fastening or mounting posts 52 that project from a bottom surface of the housing, as shown in the drawing. When the housing 50 is aligned with the IDC terminals 30*a*–30*h* and is lowered to surround the terminals, the fastening posts 52 align with corresponding openings 54 in the board 12 and pass through the openings 54 to engage a cover 60 on the bottom surface of the board. The wire board 12 is thus sandwiched or captured between the terminal housing 50 and the cover 60, so that substantially the entire rear portion of the board 12 is protected from above and below.

The jack frame 40 has a latch 64 that projects rearward from a bottom surface of the frame, as viewed in FIG. 1. The wire board cover 60 has a lower shoulder 68 next to a front end of the cover. After the wire board 12, the terminal housing 50 and the cover 60 are assembled, the front portion of the wire board 12 is inserted in the rear opening in the jack frame 40 until the frame latch 64 snaps over and onto the shoulder 68 on the bottom of the cover.

Figure 2:
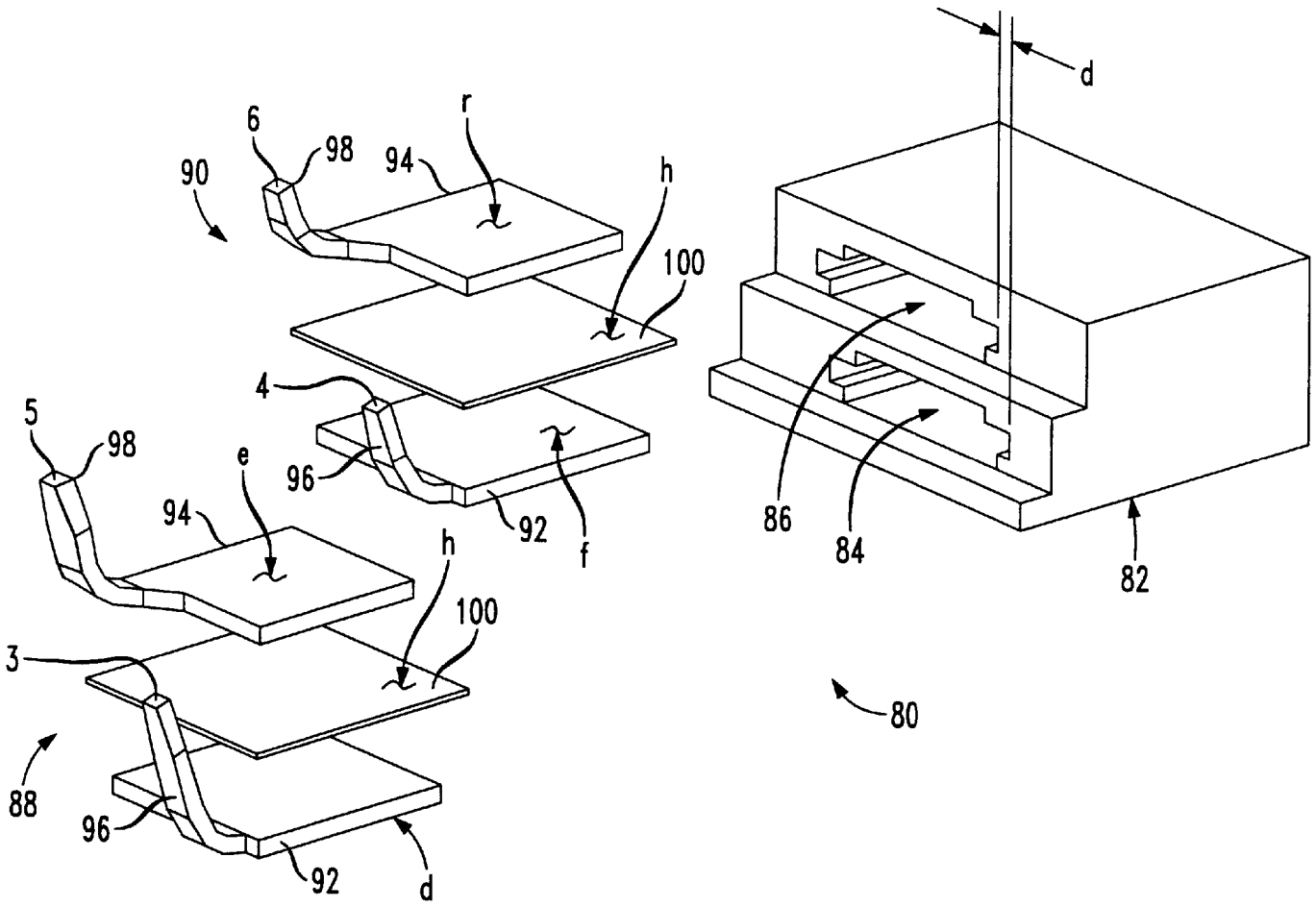
FIG. 2 is an enlarged, exploded view of a capacitor compensation assembly for providing capacitive crosstalk compensation coupling in the jack connector of FIG. 1.
Figure 3:
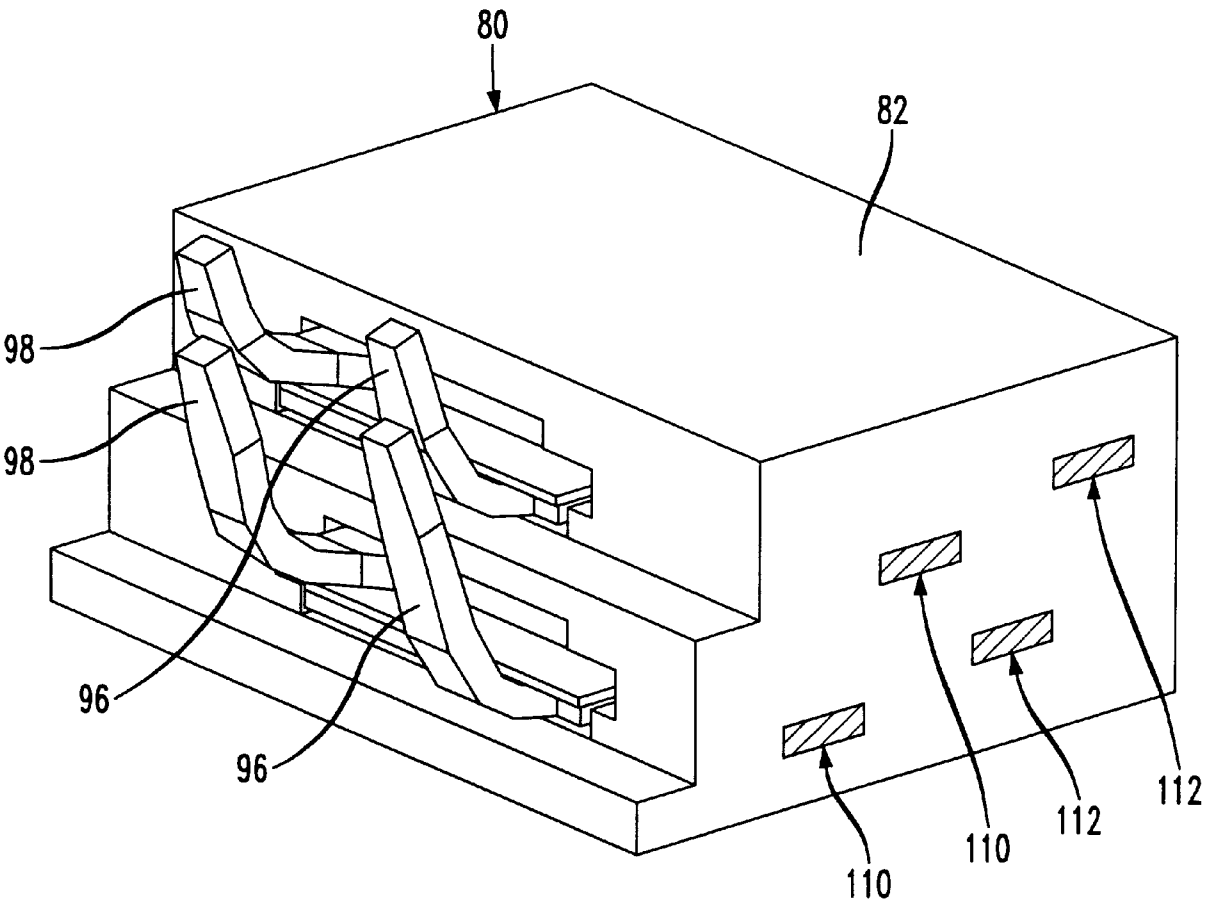
FIG. 3 is an enlarged perspective view of the capacitor compensation assembly in FIG. 2, in an assembled state.

FIG. 2 is an exploded view of a capacitor compensation assembly 80 for providing crosstalk compensation in the jack connector 10. FIG. 3 is an enlarged perspective view of the compensation assembly 80 in FIG. 2, in an assembled state.

The capacitor compensation assembly 80 comprises a housing 82 having a first opening or cavity 84, and a second opening or cavity 86. The cavities 84, 86, have relatively narrow, generally rectangular cross-sections of substantially the same dimensions. The cavities are formed in the housing 82 one above the other, but with their side walls offset horizontally by a determined distance d of, for example, 0.040 inches. This offset corresponds to the mentioned center-to-center spacing of adjacent free end portions of the terminal contact wires 16*a*–16*h* above the wire board 12.

In the disclosed embodiment, the capacitor compensation assembly 80 has two crosstalk compensation capacitors 88, 90. Each of the capacitors 88, 90, is comprised of a first metallic electrode 92 and a second metallic electrode 94. Each of the electrodes 92, 94, may be in the form of a metal plate as shown, or other equivalent form or configuration. The first electrode 92 has an associated conductive finger terminal 96, and the second electrode 94 has an associated conductive finger terminal 98. Further, each of the capacitors 88, 90, has an associated dielectric spacer 100 which is disposed between the first and the second metallic electrodes 92, 94.

In the illustrated embodiment, the first and the second electrodes 92, 94, are generally rectangular metal plates. The first electrode 92 may be longer on each side by, e.g., 0.01 inches than the second electrode 94, however. In such a case, since the second electrode 94 has a smaller area than the first electrode 92, precise alignment of the electrodes with one another is not essential to obtain a desired capacitance value between the electrode terminals, and production variations are minimized. That is, as long as the entire area of the smaller, second electrode 94 is disposed opposite an area of the first electrode 92 through the dielectric spacer 100, the capacitance value remains constant. See U.S. patent application Ser. No. 09/327,882 entitled Enhanced Communication Connector Assembly with Crosstalk Compensation, filed Jun. 8, 1999, and assigned to the assignee of the present application. All relevant portions of the '882 application are incorporated by reference.

The dielectric spacer 100 provides isolation between the metallic electrodes 92, 94. The spacer should be capable of withstanding an industry-specified breakdown voltage, for example, 1000 volts.

With the dielectric spacer 100 sandwiched between the first and the second electrodes 92, 94, of the compensation capacitors 88, 90, the two capacitors are inserted in the cavities 84, 86, in the assembly housing 82. As seen in FIG. 2, the side, top and bottom walls of the cavities 84, 86, conform closely to the outer peripheries of the capacitors 88, 90, so that the electrodes 92, 94, and the dielectric spacer of each capacitor are supported steadily with respect to the housing 82. The depth of the cavities 84, 86, in the housing 82 is such that the finger terminals 96, 98, of the capacitors are exposed and extend with a desired configuration outside of the housing 82. Because of the horizontal offset distance d in the relative alignment of capacitors 88, 90, the finger terminals 96, 98, of one capacitor are offset horizontally by the distance d with respect to the corresponding finger terminals of the other capacitor, as seen in FIG. 3.

FIG. 3 also shows an arrangement wherein the metallic electrodes 92, 94, of the capacitors can be insert molded in the housing 82. Specifically, a tab 110 is formed integrally with and projects from the right side of each electrode 92, as viewed in FIG. 3. A corresponding tab (not shown in FIG. 3) projects from the left side of each electrode 92. Likewise, a tab 112 is formed integrally with and projects from the right side of each capacitor electrode 94, and a corresponding tab projects from the left side of each electrode 94. The tabs 110, 112, thus serve to align and hold the electrodes 92, 94, in position within a molding die during an injection molding process for the assembly housing 82. lifter molding, the tabs may be trimmed flush with the sides of the assembly housing 82 as seen in FIG. 3.

Figure 4:
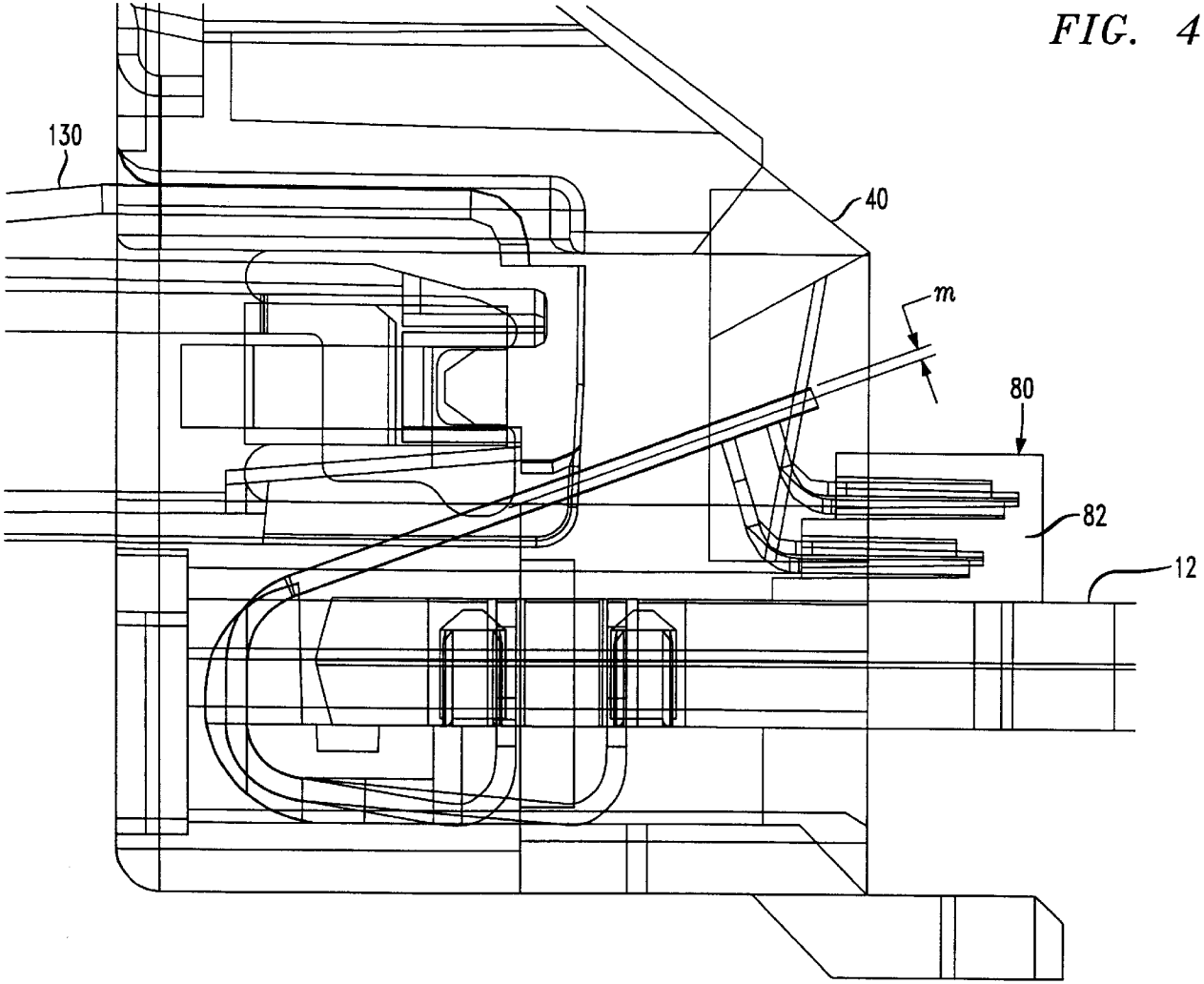
FIG. 4 is an enlarged, side view of the jack connector in FIG. 1 in a partly assembled state, and showing a mating plug connector.
Figure 5:
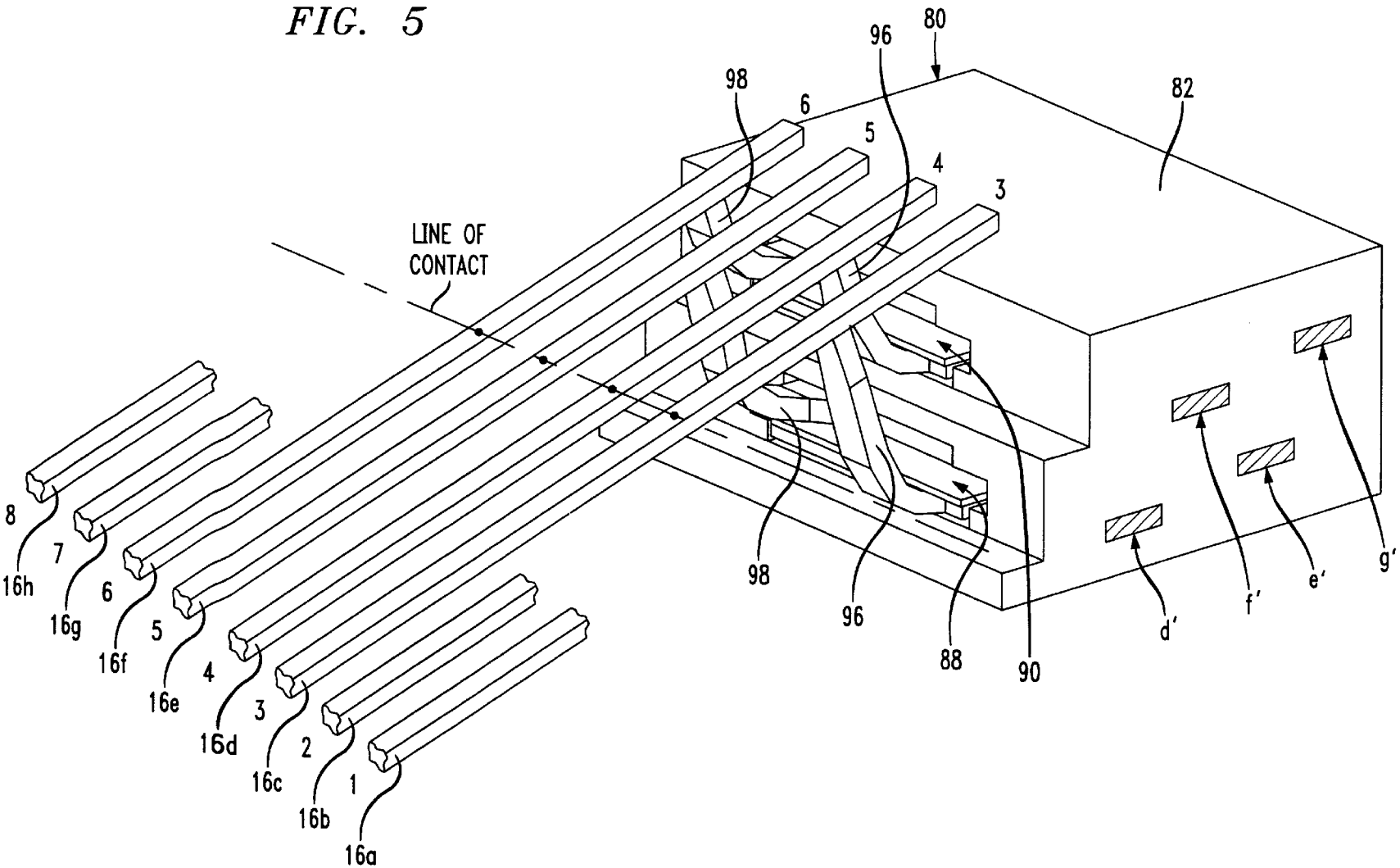
FIG. 5 is a perspective view of the jack connector in FIG. 4 as seen from the front, showing free end portions of selected terminal contact wires in electrical contact with corresponding terminals of the capacitor compensation assembly.

FIG. 1 shows the assembled capacitor compensation assembly 80 captured in a recess 120 that is formed in a front wall 122 of the IDC terminal housing 50. The assembly 80 may thus be clamped on or otherwise fixed with respect to the top of the printed wire board 12 and the free end portions of the terminal contact wires 16*a*–16*h*. FIGS. 4 and 5 show the capacitor compensation assembly 80 in the jack connector 10, in operative relation to the free end portions of the terminal contact wires. Parts of the connector 10 are omitted in FIGS. 4 and 5 for purposes of clarity. As shown in FIG. 5, the crosstalk compensation capacitors 88, 90, are supported in the assembly housing 82 so that the terminals 96, 98, of each capacitor are each aligned with a corresponding one of the terminal contact wires of the connector 10, in a direction that is generally transverse to the free end portions of the terminal contact wires 16*a*–16*h*, outside of the assembly housing 82.

When a typical plug connector 130 is inserted in the front plug opening 42 in the jack frame 40, terminals blades of the plug connector confront the terminal contact wires 16*a*–16*h*, and apply a force sufficient to overcome the pre-loading of the free end portions of the contact wires at the rear of the jack frame 40. The finger terminals 96, 98, of the capacitor compensation assembly 80 are located and configured outside of the assembly housing 82, so that free end portions of selected terminal contact wires make electrical contact with corresponding finger terminals 96, 98, of the compensation capacitors 88, 90, when the free end portions are deflected or urged toward the finger terminals by the action of the plug connector.

Once the end portions of the selected terminal contact wires touch the finger terminals 96, 98, the associated contact wires may be further deflected at their points of contact with the blades of the plug connector 130 to cause a slight wiping movement of the wire end portions on the capacitor finger terminals 96, 98. Such wiping action assures a reliable electrical contact between the selected terminal contact wires and the corresponding capacitor terminals.

Figure 6:
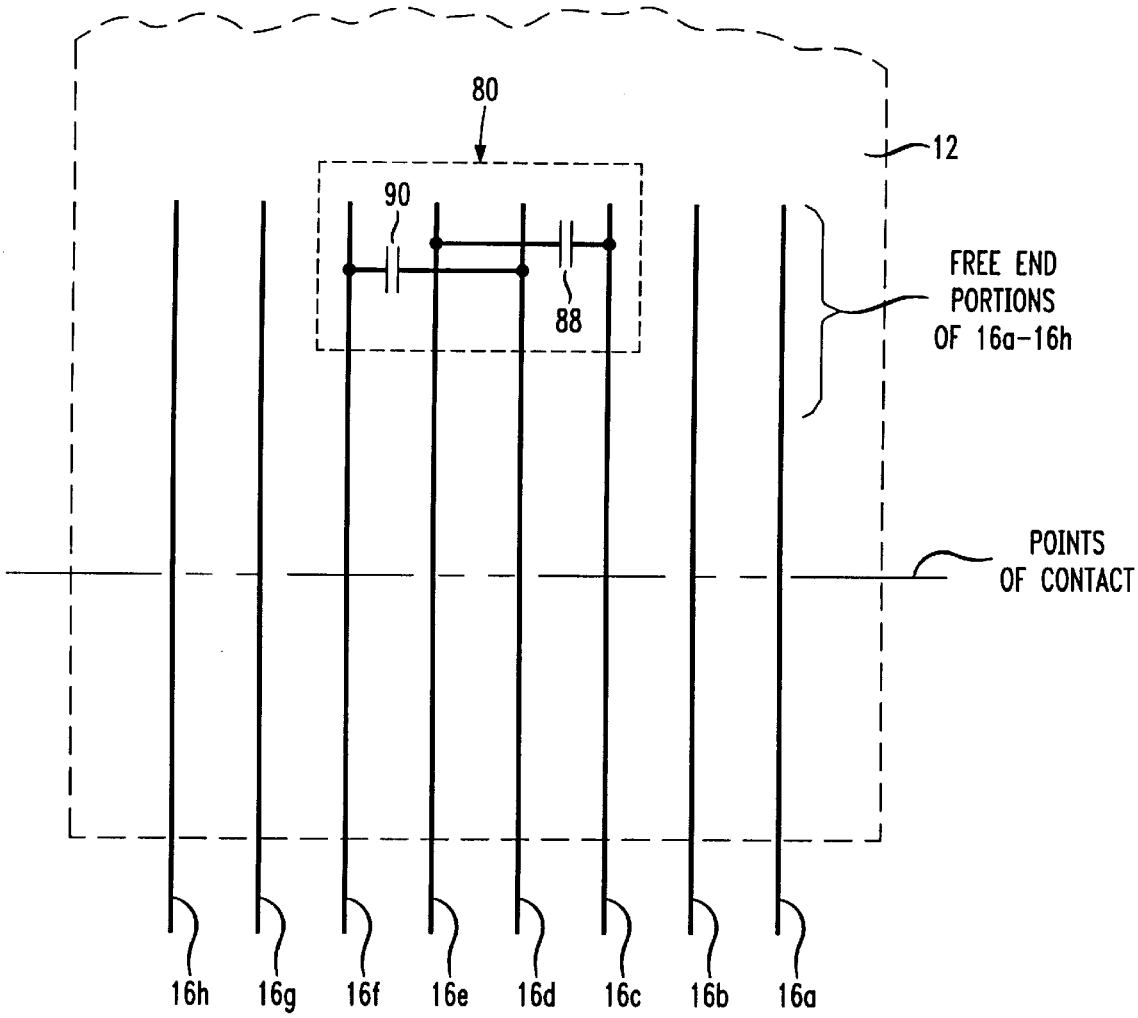
FIG. 6 is an electrical schematic diagram of the jack connector in FIGS. 4 & 5 including the capacitor compensation assembly.

FIG. 6 is a schematic representation of the jack connector 10 with the capacitor compensation assembly 80 arranged as shown in FIG. 5. In the illustrated embodiment, the finger terminals 96, 98, of capacitor 88 are positioned to contact the free ends of terminal contact wires 16*c* & 16*e*. The finger terminals 96, 98, of capacitor 90 are arranged to contact the free ends of contact wires 16*d* & 16*f*. Thus, the spacing between the finger terminals 96, 98, of each compensation capacitor 88, 90, corresponds to twice the center-to-center distance between adjacent end portions of the terminal contact wires 16*a*–16*h*.

For example, in type RJ-45 connectors, contact wire pair 16*d* and lie is used as signal wire pair "1", and contact wire pair 16*c* and 16*f* is used as signal wire pair "3". The arrangement or FIGS. 5 and 6 thus provides capacitive coupling between the pair 1 and the pair 3 signal wires for the purpose of crosstalk compensation. The capacitive coupling is injected at free ends of the contact wires with respect to their points of contact with the plug connector 130, rather than at current-carrying parts of the wires. This minimizes the effect of delay in the injection of capacitive compensation coupling into the selected signal paths.

It is believed that Category 6 near end crosstalk loss may be achieved when the connector 10 is mated with a typical existing type RJ-45 plug connector, if the value of each compensation capacitor is between about 0.5 picofarads (pf) and 3.0 pf, and up to two additional stages of crosstalk compensation are provided within the wire board 12. The final value of each capacitor should reflect an optimum balance of compensation provided by both the wire board 12 and the compensation capacitors 88, 90.

The communication jack connector disclosed herein features a capacitor compensation assembly that is disposed relatively close to the points of contact of the connector 10 with a mating connector. This arrangement provides an early stage of capacitive compensation and allows additional free space on the wire board 12 for "fine tuning" of the electrical performance of the connector 10 by way of further crosstalk compensation stages. The capacitor compensation assembly 80 may be mounted in the region of a back end of an existing jack frame such as those currently used in jack connectors available from Lucent Technologies Inc. under the style designation "MGS200". Because of its compatibility with existing jack connectors, the capacitor compensation assembly 80 can be integrated with such connectors with a minimal amount of up-front tooling time or expense.

While the foregoing description represents a preferred embodiment of the invention, it will be obvious to those skilled in the art that various changes and modifications may be made, without departing from the true spirit and scope of the invention pointed out in the following claims.

We claim:

1. A capacitor compensation assembly for crosstalk compensation in a communication connector having elongated terminal contact wires, comprising:

a housing;

a first crosstalk compensation capacitor supported in the housing, the capacitor including a first metallic electrode having a first terminal, a second metallic electrode having a second terminal, and a dielectric spacer disposed between the first and the second metallic electrodes;

wherein said housing is dimensioned and arranged to be associated with the communication connector, and the terminals of the metallic electrodes are exposed at positions outside the housing such that selected terminal contact wires of the connector make electrical contact with corresponding terminals of the electrodes to provide capacitive coupling between the selected contact wires when the contact wires are engaged by a mating connector and wherein the terminals of said capacitor are spaced apart from one another by a distance that corresponds to an integer multiple of a center-to-center spacing between the terminal contact wires of said communication connector.

2. A capacitor compensation assembly according to claim 1, wherein a second crosstalk compensation capacitor is supported in said housing.

3. A capacitor compensation assembly according to claim 2, wherein the first and the second crosstalk compensation capacitors are supported in said housing so that the terminals of the electrodes of the capacitors are aligned to correspond with selected terminal contact wires of the connector.

4. A capacitor compensation assembly according to claim 2, wherein corresponding terminals of the first and the second capacitors are offset from one another by a distance which corresponds to a center-to-center spacing between the terminal contact wires of said communication connector.

5. A communication jack connector, comprising:

a jack frame having a front surface and a plug opening in the front surface, wherein the plug opening has an axis and is formed to receive a mating plug connector;

a number of elongated terminal contact wires extending through the jack frame, wherein the contact wires are configured to make electrical contact with corresponding terminals of the mating connector;

a capacitor compensation assembly including one or more crosstalk compensation capacitors, wherein the assembly is mounted in a part of the connector in operative relation to the terminal contact wires, and wherein each compensation capacitor includes a first metallic electrode with a first terminal, a second metallic electrode with a second terminal, and a dielectric spacer disposed between the first and the second electrodes;

wherein the first and the second terminals of the metallic electrodes are located and configured so that free end portions of selected terminal contact wires make electrical contact with corresponding terminals of the electrodes to provide capacitive coupling between the selected contact wires when the contact wires are engaged by the mating connector; and wherein the terminals of a given capacitor are spaced apart from one another by a distance that corresponds to an integer multiple of a center-to-center spacing between the free end portions of the terminal contact wires.

6. A communication jack connector according to claim 5, wherein the capacitor compensation assembly includes at least two crosstalk compensation capacitors, and the terminals of the electrodes of the capacitors are aligned is to correspond with selected ones of the terminal contact wires.

7. A communication jack connector according to claim 6, wherein terminals of one capacitor are offset from corresponding terminals of another capacitor by a distance that corresponds to a center-to-center spacing between the free end portions of the terminal contact wires.

8. A communication jack connector according to claim 5, including a wire board a portion of which is mounted within the jack frame, and said crosstalk compensation capacitors are supported on the wire board in the vicinity of the free end portions of the terminal contact wires.

9. A communication jack connector according to claim 8, including a terminal housing on the wire board, the terminal housing having a front wall facing the free end portions of the terminal contact wires, and the capacitor compensation assembly is mounted on the front wall of the terminal housing.

10. A communication jack connector according to claim 5, including a wire board a portion of which is mounted in said jack frame, and said wire board is constructed and arranged to provide one or more stages of crosstalk compensation.

* * * * *